US008345824B2

(12) United States Patent
Nose et al.

(10) Patent No.: US 8,345,824 B2
(45) **Date of Patent: *Jan. 1, 2013**

(54) X-RAY METERING APPARATUS, AND X-RAY METERING METHOD

(75) Inventors: Hiroyuki Nose, Tokyo (JP); Daisuke Ishida, Tokyo (JP); Namio Kaneko, Tokyo (JP); Yasuo Sakai, Tokyo (JP); Mitsuru Uesaka, Tokyo (JP); Fumito Sakamoto, Tokyo (JP); Katsuhiro Dobashi, Tokyo (JP)

(73) Assignees: IHI Corporation, Tokyo (JP); The University of Tokyo, Tokyo (JP)

( * ) Notice: Subject to any disclaimer, the term of this patent is extended or adjusted under 35 U.S.C. 154(b) by 378 days.

This patent is subject to a terminal disclaimer.

(21) Appl. No.: 12/667,500

(22) PCT Filed: Jul. 1, 2008

(86) PCT No.: PCT/JP2008/061906

§ 371 (c)(1),
(2), (4) Date: Jun. 23, 2010

(87) PCT Pub. No.: WO2009/005061

PCT Pub. Date: Jan. 8, 2009

(65) Prior Publication Data

US 2011/0026679 A1 Feb. 3, 2011

(30) Foreign Application Priority Data

Jul. 4, 2007 (JP) ..... 2007-175739

(51) Int. Cl.
*G21G 4/00* (2006.01)

(52) U.S. Cl. ..... 378/119; 378/210

(58) Field of Classification Search ..... 378/210, 378/86–90, 143, 119, 121
See application file for complete search history.

(56) References Cited

U.S. PATENT DOCUMENTS

| | | | | |
|---|---|---|---|---|
| 6,377,651 | B1 | 4/2002 | Richardson et al. | |
| 6,687,333 | B2 | 2/2004 | Carroll et al. | |
| 7,372,056 | B2 | 5/2008 | Bykanov et al. | |
| 7,382,861 | B2 | 6/2008 | Madey et al. | |
| 2002/0057760 | A1 * | 5/2002 | Carroll et al. | 378/119 |
| 2008/0031420 | A1 * | 2/2008 | Loewen et al. | 378/119 |
| 2010/0080356 | A1 * | 4/2010 | Ishida et al. | 378/121 |

FOREIGN PATENT DOCUMENTS

JP 07-110400 4/1995

(Continued)

OTHER PUBLICATIONS

International Search Report, issued in corresponding application No. PCT/JP2008/061906, completed Jul. 17, 2008, mailed Jul. 29, 2008.

(Continued)

*Primary Examiner* — Hoon Song
(74) *Attorney, Agent, or Firm* — Griffin & Szipl, P.C.

(57) ABSTRACT

An X-ray waveform is generated by validating detection data corresponding to when an X-ray (4) is generated at a collision point (9) among X-ray detection data and invalidating other data. For example, when laser light (3) is pulse laser light and an electron beam (1) is a continuous electron beam or a pulse-like electron beam having a pulse width equal to or greater than that of the pulse laser light, the X-ray waveform is generated by detecting the laser light (3) and multiplying the X-ray detection data by laser light detection data after making time axes coincident with respect to the collision point (9).

12 Claims, 5 Drawing Sheets

FOREIGN PATENT DOCUMENTS

| | | | |
|---|---|---|---|
| JP | 11-142786 | | 5/1999 |
| JP | 2001-338796 | A | 12/2001 |
| JP | 2001-345503 | | 12/2001 |
| JP | 2002-011584 | | 1/2002 |
| JP | 3463281 | B2 | 11/2003 |
| JP | 2004-226271 | | 8/2004 |
| JP | 2004-227952 | | 8/2004 |
| JP | 2005-285764 | | 10/2005 |
| JP | 2006-318745 | | 11/2006 |
| JP | 2006-318746 | | 11/2006 |
| JP | 2006-344731 | | 12/2006 |
| WO | 2006/121126 | A1 | 11/2006 |

OTHER PUBLICATIONS

International Search Report, issued in corresponding application No. PCT/JP2008/061904, completed Aug. 5, 2008, mailed Aug. 19, 2008.

U.S. Office Action issued in co-pending U.S. Appl. No. 12/667,509, dated Apr. 25, 2011.

Extended European Search Report, issued on Sep. 6, 2011, in corresponding European Patent Application No. 08790769.7.

Akira Endo, "Characterization of the Monochromatic Laser Compton-X-Ray Beam with Picosecond and Femtosecond Pulse Widths", Proceedings of SPIE, vol. 4502, Jan. 1, 2001, pp. 100-108.

Extended European Search Report, issued on Jul. 28, 2011, in corresponding European Patent Application No. 08790767.1.

Katsuhiro Dohashi et al., "Development of Small-Sized Hard X-Ray Source using X-Band Linac," 27-th Linac Technology Research Meeting, 2002, pp. 1-3.

International Search Report, issued in corresponding application No. PCT/JP2008/061905, completed Sep. 25, 2008, mailed Oct. 7, 2008.

Yasuo Suzuki et al., A New Laser Mass Spectrometry for Chemical Ultratrace Analysis Enhanced with Multi-Mirror System (RIM-MPA), Analitical Science, 2001, vol. 17 Supplement.

* cited by examiner

X-RAY METERING APPARATUS, AND X-RAY METERING METHOD

This is a National Phase Application in the United States of International Patent Application No. PCT/JP2008/061906 filed Jul. 1, 2008, which claims priority on Japanese Patent Application No. 2007-175739, filed Jul. 4, 2007. The entire disclosures of the above patent applications are hereby incorporated by reference.

BACKGROUND OF THE INVENTION

1. Technical Field of the Invention

The present invention relates to an X-ray metering apparatus and an X-ray metering method that measure an X-ray generated by inverse Compton scattering by colliding an electron beam with laser light.

2. Description of the Related Art

As means for generating an X-ray by a small-sized device, there is known an X-ray generator capable of obtaining a monochromatic X-ray arisen from inverse Compton scattering by a collision between an electron beam and laser light.

As an example of the X-ray generator, contents disclosed in the following Patent Document 1 are illustrated in FIG. 1. The X-ray generator illustrated in FIG. 1 includes an electron beam generator 52 which accelerates a pulse electron beam 51 and passes the beam through a predetermined rectilinear orbit 50; a laser generator 53 which generates pulse laser light 66; a synchronizer 54 which acquires synchronization between the electron beam generator 52 and the laser generator 53; and a laser light introduction unit 55 which introduces the pulse laser light 66 onto the rectilinear orbit 50 to be opposed to the pulse electron beam 51. The electron beam generator 52 has an RF electron gun 56, an α-magnet 57, an acceleration tube 58, a bending magnet 59, a deceleration tube 60, and a beam dump 61. The laser generator 53 has a laser control unit 62 and a pulse laser unit 63. The laser introduction unit 55 has a first mirror 64 and a second mirror 65. The X-ray generator constituted as described above generates a monochromatic hard X-ray 68 by colliding the laser light 66 with the electron beam 51 at a collision point 67.

[Patent Document 1] Japanese Patent Application Laid-Open No. 2006-318745

As illustrated in FIG. 2, an X-ray generated by the X-ray generator is detected by an X-ray detector 71. In FIG. 2, reference numeral 72 denotes a collision chamber in which a collision point 67 is set and reference numeral 73 denotes a duct surrounding paths of the electron beam 51 and the laser light 66.

Apart from the X-ray 68 generated by inverse Compton scattering in the above-described X-ray generator, an X-ray 74 generated by braking radiation or an X-ray generated upon collision of the electron beam 51 in a duct 73 exists as noise. To remove this noise, a collimator 75 or a shield 76 is installed around the X-ray detector 71. Since the shield 76 for shielding the noise X-ray must be large, there is a problem in that it is difficult to miniaturize the peripheral of the X-ray detector 71 and therefore a size of the whole device increases. Since the collimator 75 or the shield 76 may not remove the noise X-ray entering the X-ray detector in the same direction as the X-ray 68 generated by inverse Compton scattering, there is a problem in that the S/N ratio may deteriorate.

SUMMARY OF THE INVENTION

The present invention has been made to solve the above-described problem, and an object of the invention is to provide an X-ray metering apparatus and an X-ray metering method capable of reducing or eliminating a shield and improving an S/N ratio.

To solve the above-described problem, the X-ray metering apparatus and the X-ray metering method of the present invention adopt the following means.

The present invention is characterized by an X-ray metering apparatus for measuring an X-ray generated by inverse Compton scattering by colliding an electron beam with laser light at a predetermined collision point, the apparatus comprising: an X-ray detector which detects an X-ray; and an X-ray meter which generates an X-ray waveform on the basis of X-ray detection data from the X-ray detector, wherein the X-ray meter generates the X-ray waveform by validating detection data corresponding to when the X-ray is generated at the collision point among the X-ray detection data from the X-ray detector and invalidating other data.

The present invention is characterized by an X-ray metering method for measuring an X-ray generated by inverse Compton scattering by colliding an electron beam with laser light at a predetermined collision point, the method comprising: detecting an X-ray; and generating an X-ray waveform by validating detection data corresponding to when the X-ray is generated at the collision point among obtained X-ray detection data and invalidating other data.

According to the above-described apparatus and method, since an X-ray waveform is generated by validating detection data corresponding to when the X-ray is generated at the collision point among obtained X-ray detection data and invalidating other data, only an X-ray waveform by inverse Compton scattering is generated and a waveform by a noise X-ray other than the X-ray waveform is not generated. That is, since an X-ray waveform is generated in a form in which a noise X-ray component is removed, a shield may be reduced or eliminated and an X-ray may be measured at a high S/N ratio. Since the peripheral of the X-ray detector may be compactly designed by reducing the shield, it is possible to miniaturize the whole device.

In the above-described X-ray metering apparatus, the laser light is pulse laser light and the electron beam is a continuous electron beam or a pulse-like electron beam having a pulse width equal to or greater than that of the pulse laser light, a laser light detector which detects the laser light is provided, and the X-ray meter generates the X-ray waveform by multiplying the X-ray detection data from the X-ray detector by laser light detection data from the laser light detector after making time axes coincident with respect to the collision point.

In the above-described X-ray metering method, the laser light is pulse laser light and the electron beam is a continuous electron beam or a pulse-like electron beam having a pulse width equal to or greater than that of the pulse laser light, and the X-ray waveform is generated by detecting the laser light and multiplying the X-ray detection data by laser light detection data after making time axes coincident with respect to the collision point.

As such, when both the laser light and the electron beam are pulse-like and a pulse width of the electron beam is equal to or greater than that of the laser light, or when the laser light is pulse-like and the electron beam is continuous, an X-ray is generated by inverse Compton scattering in a time when the laser light is passed through the collision point. When the X-ray detection data is multiplied by laser light detection data after making time axes coincident with respect to the collision point, an output value of X-ray detection data multiplied by a part in which laser light is not output becomes zero. As a result, there remains the part in which the laser light is output, that is, only a part in which an X-ray generated by inverse Compton scattering is detected, and other noise X-ray components are removed.

In the above-described X-ray metering apparatus, the laser light is pulse laser light, the electron beam is a continuous electron beam or a pulse-like electron beam having a pulse width equal to or greater than that of the pulse laser light, and the X-ray meter generates the X-ray waveform by removing detection data, other than detection data corresponding to when the laser light is passed through the collision point, from among the X-ray detection data from the X-ray detector.

In the above-described X-ray metering method, the laser light is pulse laser light, the electron beam is a continuous electron beam or a pulse-like electron beam having a pulse width equal to or greater than that of the pulse laser light, and the X-ray waveform is generated by removing detection data, other than detection data when the laser light is passed through the collision point, from among the X-ray detection data from the X-ray detector.

As such, since the X-ray waveform is generated by removing the detection data, other than detection data corresponding to when the laser light is passed through the collision point, from among the X-ray detection data, there remains only a part in which an X-ray generated by inverse Compton scattering is detected and other noise X-ray components are removed.

In the above-described X-ray metering apparatus, the electron beam is a pulse-like electron beam, the laser light is continuous laser light or pulse laser light having a pulse width equal to or greater than that of the electron beam, a beam detector which detects passing of the electron beam is provided, and the X-ray meter generates the X-ray waveform by multiplying the X-ray detection data from the X-ray detector by beam detection data from the beam detector after making time axes coincident with respect to the collision point.

In the above-described X-ray metering method, the electron beam is a pulse-like electron beam, the laser light is continuous laser light or pulse laser light having a pulse width equal to or greater than that of the electron beam, and the X-ray waveform is generated by detecting passing of the electron beam and multiplying the X-ray detection data by beam detection data after making time axes coincident with respect to the collision point.

As such, when the laser light is continuous and the electron beam is pulse-like or when both the laser light and the electron beam are pulse-like and a pulse width of the laser light is equal to or greater than that of the electron beam, an X-ray is generated by inverse Compton scattering in a time when the electron beam is passed through the collision point. When the X-ray detection data is multiplied by beam detection data after making time axes coincident with respect to the collision point, an output value of X-ray detection data multiplied by a part in which an electron beam is not output becomes zero. As a result, there remains the part in which the electron beam is output, that is, only a part in which an X-ray generated by inverse Compton scattering is detected, and other noise X-ray components are removed.

In the above-described X-ray metering apparatus, the electron beam is a pulse-like electron beam, the laser light is continuous laser light or pulse laser light having a pulse width equal to or greater than that of the electron beam, and the X-ray meter generates the X-ray waveform by removing detection data, other than detection data corresponding to when the electron beam is passed through the collision point, from among the X-ray detection data from the X-ray detector.

In the above-described X-ray metering method, the electron beam is a pulse-like electron beam, the laser light is continuous laser light or pulse laser light having a pulse width equal to or greater than that of the electron beam, and the X-ray waveform is generated by removing detection data, other than detection data when the electron beam is passed through the collision point, from among the X-ray detection data from the X-ray detector.

As such, since the X-ray waveform is generated by removing the detection data, other than detection data corresponding to when the electron beam is passed through the collision point, from an X-ray output waveform, there remains only a part in which an X-ray generated by inverse Compton scattering is detected and other noise X-ray components are removed.

The present invention is characterized by an X-ray metering apparatus for measuring an X-ray generated by inverse Compton scattering by colliding an electron beam with laser light at a predetermined collision point, the apparatus comprising: an X-ray detector which detects an X-ray; an X-ray meter which generates an X-ray waveform on the basis of X-ray detection data from the X-ray detector; and a detector controller which controls the X-ray detector, wherein the detector controller controls the X-ray detector to detect the X-ray only when the X-ray generated at the collision point enters the X-ray detector.

In the present invention, there is provided an X-ray metering method for measuring an X-ray generated by inverse Compton scattering by colliding an electron beam with laser light at a predetermined collision point, the method comprising: detecting an X-ray only when the X-ray generated at the collision point enters an X-ray detector; and generating an X-ray waveform on the basis of obtained X-ray detection data.

According to the above-described apparatus and method, since an X-ray is detected only when the X-ray generated at the collision point enters the X-ray detector, only an X-ray generated by inverse Compton scattering may be detected. Accordingly, an X-ray may be measured at a high S/N ratio even when the shield is reduced or eliminated. Since the peripheral of the X-ray detector may be compactly designed by reducing the shield, it is possible to miniaturize the whole device.

According to the present invention, there is an excellent effect that a shield may be reduced and eliminated and an S/N ratio may be improved.

DESCRIPTION OF THE PREFERRED EMBODIMENT

Figure 1:
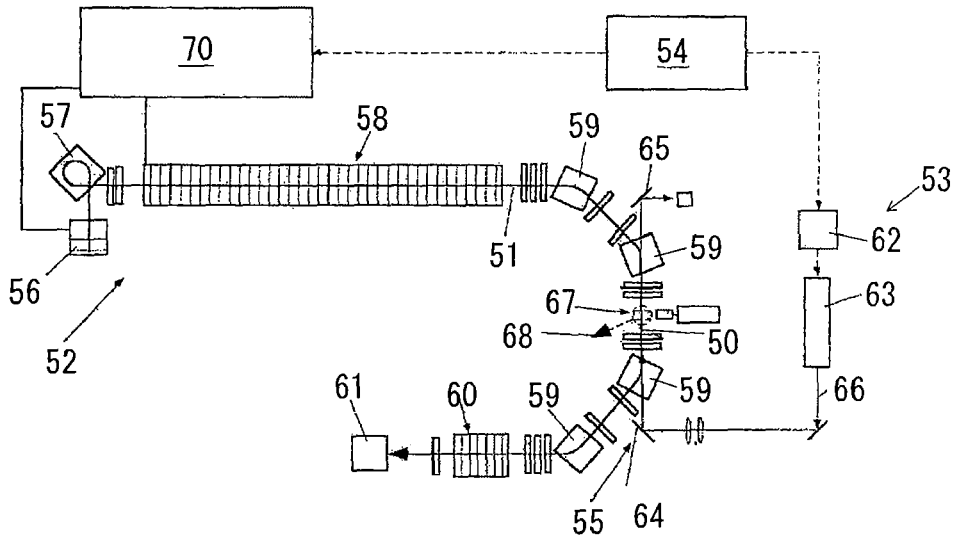
Fig. 1 Prior Art
FIG. 1 is the whole constitution diagram of an X-ray generator disclosed in Patent Document 1.
Figure 2:
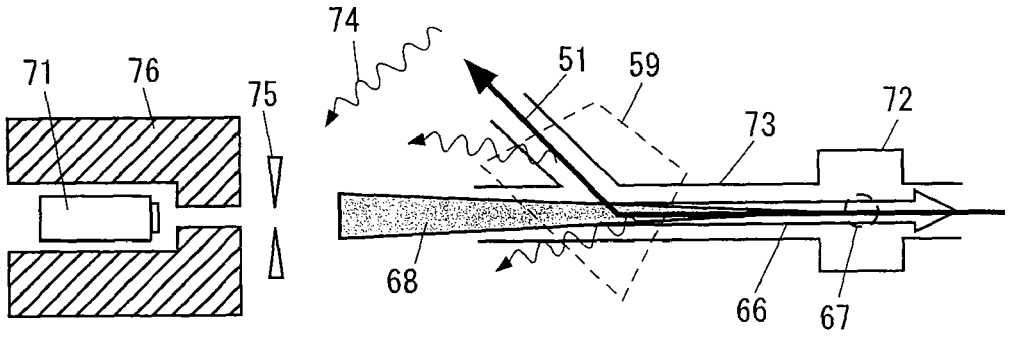
Fig. 2 Prior Art
FIG. 2 is a diagram illustrating a problem of the prior art.

A preferable embodiment of the present invention will hereinafter be described in detail with reference to the drawings. It is to be noted that, in the drawings, common parts are denoted by the same reference numerals, and redundant description thereof is omitted.

First Embodiment

Figure 3:
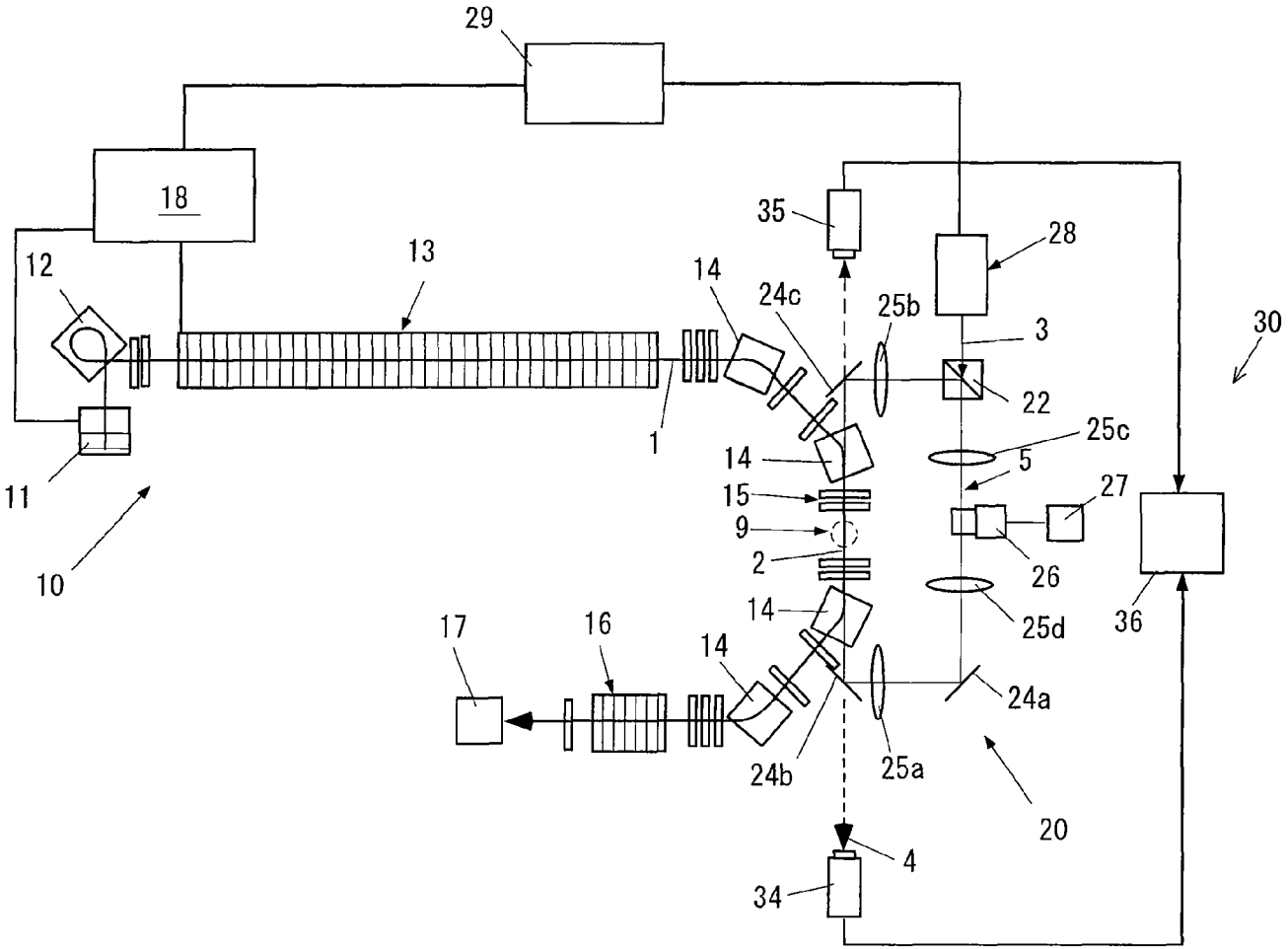
FIG. 3 is the whole constitution diagram of an X-ray generator having an X-ray metering apparatus according to a first embodiment of the present invention.

FIG. 3 is the whole constitution diagram of an X-ray generator having an X-ray metering apparatus according to a first embodiment of the present invention. The X-ray generator includes an electron beam generator 10, a laser light circulator 20, a laser generator 28, a synchronizer 29, and an X-ray metering apparatus 30, and is a device that generates an X-ray 4 by inverse Compton scattering by colliding an electron beam 1 with pulse laser light 3 and measures the generated X-ray by the X-ray metering apparatus 30.

The electron beam generator 10 has a function of generating the electron beam 1 by accelerating an electron beam and passing the electron beam through a predetermined rectilinear orbit 2.

In this example, the electron beam generator 10 includes an RF electron gun 11, an α-magnet 12, an acceleration tube 13, a bending magnet 14, Q-magnets 15, a deceleration tube 16, and a beam dump 17.

The RF electron gun 11 and the acceleration tube 13 are driven by a high-frequency power source 18 of an X-band (11.424 GHz). An orbit of the electron beam drawn from the RF electron gun 11 is changed by the α-magnet 12, and the beam then enters the acceleration tube 13. The acceleration tube 13 is a small-sized X-band acceleration tube, which accelerates the electron beam to generate a high-energy electron beam of preferably about 50 MeV.

The bending magnet 14 bends the orbit of the pulse electron beam 1 with a magnetic field, passes the beam through a predetermined rectilinear orbit 2, and guides the passed pulse electron beam 1 to the beam dump 17. The Q-magnets 15 regulate a convergence degree of the pulse electron beam 1. The deceleration tube 16 decelerates the pulse electron beam 1. The beam dump 17 traps the pulse electron beam 1 passed through the rectilinear orbit 2 to prevent radiation leakage.

By using the electron beam generator 10 described above, the pulse electron beam 1, for example, having energy of about 50 MeV and a pulse width of about 1 μs may be generated and passed through the predetermined rectilinear orbit 2. The electron beam 1 may be continuously output.

The laser light circulator 20 is adapted to repeatedly pass the pulse laser light 3 through a collision point 9 within a circulation path 5 by introducing the pulse laser light 3 (P-polarized light) from the external laser generator 28 into the circulation path 5 through a polarization beam splitter 22 and confining the pulse laser light 3 within the circulation path 5 for circulating the pulse laser light. For example, a YAG laser, a YLF laser, or an excimer laser may be used as the laser generator 28. For example, the pulse frequency of pulse laser light is 10 Hz, and the pulse width is 10 ns.

When both the electron beam 1 and the laser light 3 are pulse-like, the pulse widths of the two may be the same.

In this figure, the laser light circulator 20 includes the polarization beam splitter 22, a plurality of (in this figure, three) reflection mirrors 24*a*, 24*b*, 24*c*, a plurality of (in this figure, four) lenses 25*a*, 25*b*, 25*c*, 25*d*, a Pockels cell 26, and a control unit 27.

The polarization beam splitter 22 directly passes first rectilinear polarization light (P-polarized light) and perpendicularly reflects second rectilinear polarization light (S-polarized light) orthogonal thereto.

The three reflection mirrors 24*a*, 24*b*, 24*c* constitute the circulation path 5, which circulates the pulse laser light 3 to the polarization beam splitter 22, by reflecting the pulse laser light 3 output from the polarization beam splitter 22 multiple times (three times in this figure).

The Pockels cell 26 is placed at a downstream side of the polarization beam splitter 22 within the circulation path 5 and rotates a polarization direction of polarized light, passing therethrough upon voltage application, by 90 degrees. The Pockels cell is non-linear optical crystal capable of quickly switching a polarization direction of a light beam.

The control unit 27 controls the Pockels cell 26 so that the pulse laser light 3 constantly becomes the second rectilinear polarized light (S-polarized light) circulated and input to the polarization beam splitter 22.

The laser light circulator 20 of the above-described constitution confines the pulse laser light 3 within the circulation path 5 for circulating the pulse laser light and repeatedly passes the pulse laser light 3 through the collision point 9 within the circulation path, thereby increasing a collision rate between an electron beam 1 and laser light 3 and increasing an X-ray generation output.

In the present invention, the above-described laser light circulator 20 is not essential. This may be omitted and the pulse laser light 3 may be used in a once-through way.

It is not essential to have an arrangement in which the electron beam generator 10 and the laser light circulator 20 are disposed to head-on collide the electron beam 1 with the laser light 3, and incident angles of the electron beam 1 and the laser light 3 may be crossed (e.g., 90 degrees). Alternatively, it is preferred that the electron beam generator 10 and the laser light circulator 20 are disposed so that the electron beam 1 head-on collides with the laser light 3 as illustrated in FIG. 3. According to this constitution, a high brightness X-ray may be efficiently generated.

The synchronizer 29 acquires synchronization between the electron beam generator 10 and the laser generator 30 and controls the timing of generating the pulse electron beam 1 and the timing of generating the pulse laser light 3 so that the pulse electron beam 1 collides with the pulse laser light 3 at the collision point 9 on the predetermined rectilinear orbit 2.

The X-ray metering apparatus 30 is a device for measuring an X-ray 4 generated by inverse Compton scattering at the collision point 9. The X-ray metering apparatus 30 includes an X-ray detector 34 that detects the X-ray 4 and an X-ray meter 36 that generates an X-ray waveform on the basis of X-ray detection data from the X-ray detector 34.

The X-ray meter 36 generates an X-ray waveform by validating detection data corresponding to when the X-ray 4 is generated at the collision point 9 among the X-ray detection data from the X-ray detector 34 and invalidating other data.

According to the X-ray metering apparatus 30 of the above-described constitution, since an X-ray waveform is generated by validating detection data corresponding to when the X-ray 4 is generated at the collision point 9 among obtained X-ray detection data and invalidating other data, only a waveform of X-rays 4 by inverse Compton scattering is generated and a waveform by a noise X-ray other than the X-ray waveform is not generated. That is, since an X-ray waveform is generated in a form in which a noise X-ray component is removed, a shield may be reduced or eliminated and the X-ray 4 may be measured at a high S/N ratio. Since the peripheral of the X-ray detector 34 may be compactly designed by reducing the shield, it is possible to miniaturize the whole device.

Hereinafter, the X-ray metering apparatus 30 will be described more specifically.

Figure 4:
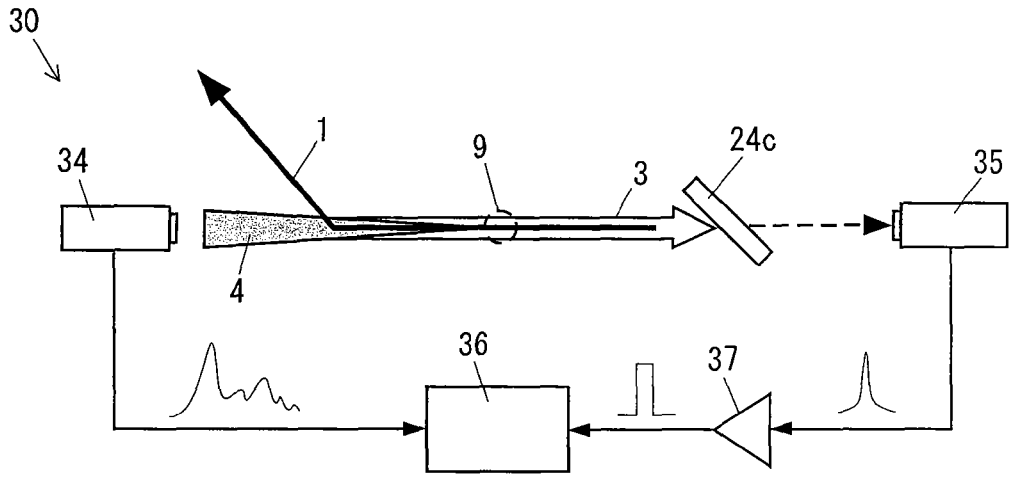
FIG. 4 is a diagram illustrating the constitution of the X-ray metering apparatus according to the first embodiment of the present invention.

FIG. 4 is a diagram illustrating a specific constitution of the X-ray metering apparatus 30 of this embodiment. An ion chamber, a semiconductor detector, a scintillator, or the like may be used as the X-ray detector 34. A high-precision oscilloscope or the like may be used as the X-ray meter 36.

As illustrated in FIG. 4, the X-ray metering apparatus 30 of this embodiment further includes a laser light detector 35 that detects laser light 3. A biplanar phototube or the like may be used as the laser light detector 35. As illustrated in FIG. 4, for example, the laser light detector 35 installed on the backside of the reflection mirror 24*c* detects laser light 3 transmitted without being reflected among laser lights 3 entering the reflection mirror 24*c*. A mountain-shaped signal from the laser light detector 35 is converted into a rectangular signal on the basis of a certain threshold by a discriminator 37 and is input to the X-ray meter 36.

In this embodiment, the X-ray meter 36 generates an X-ray waveform by multiplying the X-ray detection data from the X-ray detector 34 by laser light detection data from the laser light detector 35 after making time axes coincident with respect to the collision point 9.

Figure 5A:
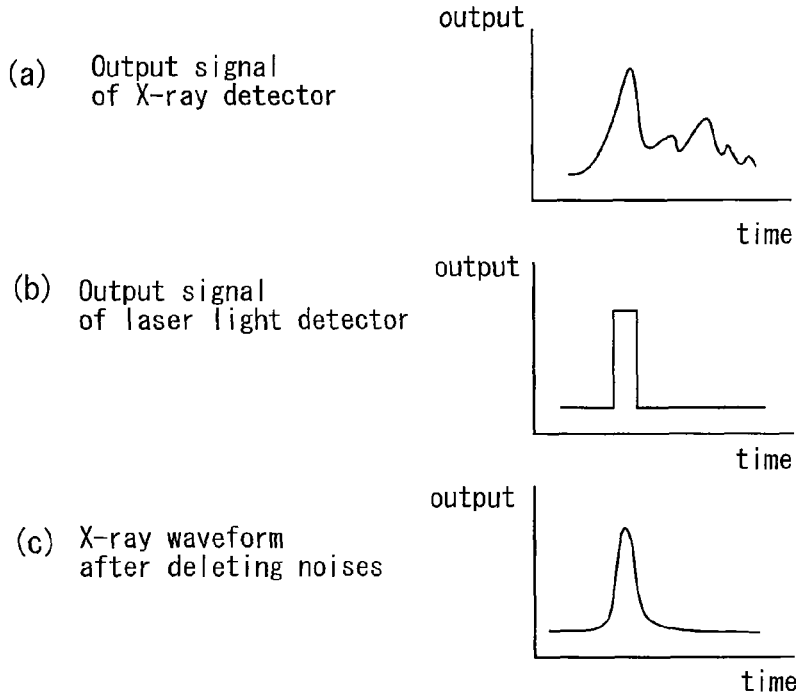
FIGS. 5A and 5B are schematic diagrams of a method of generating an X-ray waveform by an X-ray meter.
Figure 5B:
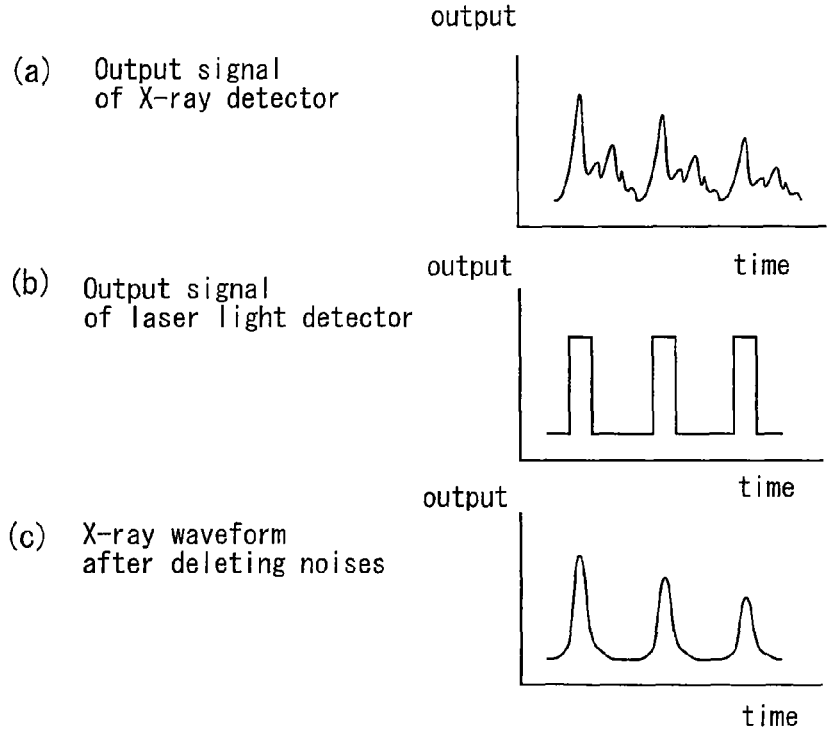

FIGS. 5A and 5B are schematic diagrams of a method of generating an X-ray waveform by the X-ray meter 36. FIG. 5A shows when the laser light 3 is allowed to collide with the electron beam 1 once in a non-circulation state, and FIG. 5B shows when the laser light 3 is allowed to collide with the electron beam 1 multiple times by circulating the laser light 3 by the laser light circulator 20. In FIGS. 5A and 5B, (a) the top is a waveform based on an output signal (X-ray detection data) of the X-ray detector 34, (b) the middle is a waveform based on an output signal (laser light detection data) of the laser light detector 35, and (c) the bottom is an X-ray waveform generated by the X-ray meter 36.

When both the laser light 3 and the electron beam 1 are pulse-like and a pulse width of the electron beam 1 is equal to or greater than that of the laser light 3, or when the laser light 3 is pulse-like and the electron beam 1 is continuous, as in this embodiment, the X-ray 4 is generated by inverse Compton scattering in a time when the laser light 3 is passed through the collision point 9. By using this, a noise X-ray may be removed by filtering the X-ray detection data in the time in which the laser light 3 is passed through the collision point 9.

Specifically, the X-ray meter 36 multiplies the X-ray detection data from the X-ray detector 34 by the laser light detection data from the laser light detector 35 on the basis of a distance between the collision point 9 and the X-ray detector 34 and a distance between the collision point 9 and the laser light detector 35, after making the time axes coincident with respect to the collision point 9. That is, a process of multiplying the waveform (the top of FIGS. 5A and 5B) based on the X-ray detection data by the waveform (the middle of FIGS. 5A and 5B) based on the laser light detection data is performed by adjusting the time axes. Then, only a part corresponding to when the X-ray 4 is generated by inverse Compton scattering at the collision point 9 remains among the X-ray detection data, and an output value of the other part becomes zero, so that an X-ray waveform from which a noise X-ray has been removed is generated as illustrated in the bottom of FIGS. 5A and 5B.

As another constitution example of this embodiment, the X-ray meter 36 may be adapted to generate an X-ray waveform by removing detection data, other than detection data corresponding to when the laser light 3 is passed through the collision point 9, from among the X-ray detection data from the X-ray detector 34. In this case, a moment (timing) when the laser light 3 is passed through the collision point 9 may be computed from the laser light detection data from the laser light detector 35 and the distance between the collision point 9 and the laser light detector 35 as illustrated in FIG. 4. Alternatively, the moment when the laser light 3 is passed through the collision point 9 may be computed from the timing of a synchronization signal from the synchronizer 29 and the time until the laser light 3 corresponding to the synchronization signal given to the laser generator 28 reaches the collision point 9.

As such, when an X-ray waveform is generated by removing detection data, other than detection data corresponding to when the laser light 3 is passed through the collision point 9, from among the X-ray detection data, there remains only a part in which the X-ray 4 generated by inverse Compton scattering is detected and other noise X-ray components are removed. Accordingly, the X-ray 4 may be measured at a high S/N ratio even when the shield is reduced or eliminated.

Second Embodiment

Figure 6:
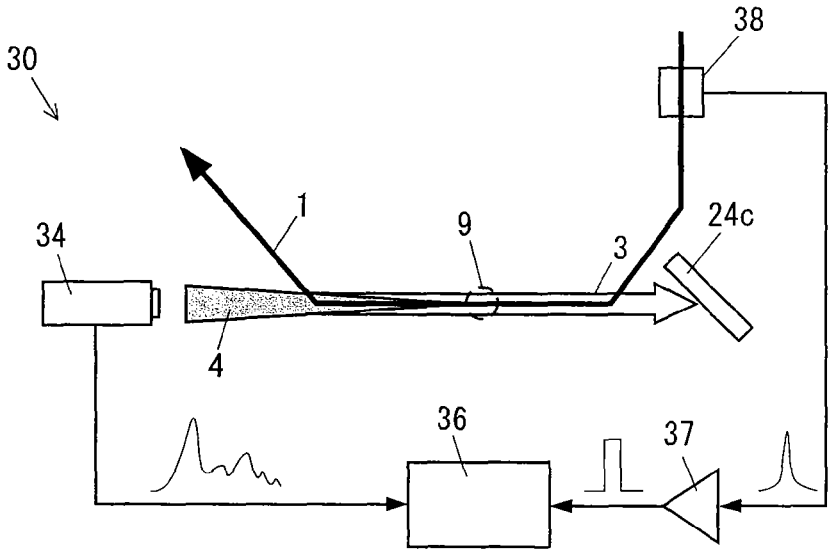
FIG. 6 is a diagram illustrating the constitution of an X-ray metering apparatus according to a second embodiment of the present invention.

FIG. 6 is a constitution diagram of the X-ray metering apparatus 30 according to a second embodiment of the present invention.

An X-ray generator having the X-ray metering apparatus 30 of this embodiment has basically the same constitution as described with reference to the first embodiment. However, in the X-ray generator having the X-ray metering apparatus 30 of this embodiment, an electron beam 1 is a pulse-like electron beam 1 and laser light 3 is continuous laser light or pulse laser light having a pulse width equal to or greater than that of the electron beam 1.

As illustrated in FIG. 6, the X-ray metering apparatus 30 of this embodiment includes a beam detector 38 that detects passing of the electron beam 1, in place of the laser light detector 35 of the first embodiment. Preferably, the beam detector 38 detects the electron beam 1 in a non-contact type. This non-contact type beam detector 38 may be constituted by a conductive coil surrounding a path of the electron beam 1 and a current detector which detects an induced current occurring in the conductive coil.

A mountain-shaped signal from the beam detector 38 is converted into a rectangular signal on the basis of a certain threshold by a discriminator 37 and is input to an X-ray meter 36.

When the laser light 3 is continuous and the electron beam 1 are pulse-like or when both the laser light 3 and the electron beam 1 are pulse-like and a pulse width of the laser light 3 is equal to or greater than that of the electron beam 1, as in this embodiment, the X-ray 4 is generated by inverse Compton scattering in a time when the electron beam 1 is passed through a collision point 9. By using this, a noise X-ray may be removed by filtering the X-ray detection data in the time when the electron beam 1 is passed through the collision point 9.

Specifically, the X-ray meter 36 multiplies the X-ray detection data from the X-ray detector 34 by the beam detection data from the beam detector 38 after making time axes coincident with respect to the collision point 9. Then, there remains only a part corresponding to when the X-ray 4 is generated by inverse Compton scattering at the collision point 9 among the X-ray detection data, and an output value of the other part becomes zero, so that an X-ray waveform from which the noise X-ray has been removed is generated as illustrated in the bottom of FIGS. 5A and 5B.

Accordingly, since an X-ray waveform is generated in a form in which a noise X-ray component is removed in this embodiment, the X-ray 4 may be measured at a high S/N ratio even when a shield is reduced or eliminated. Since the peripheral of the X-ray detector 34 may be compactly designed by reducing the shield, it is possible to miniaturize the whole device.

As another constitution example of this embodiment, the X-ray meter 36 may be adapted to generate an X-ray waveform by removing detection data, other than detection data corresponding to when the electron beam 1 is passed through the collision point 9, from among the X-ray detection data from the X-ray detector 34. In this case, a moment (timing) when the electron beam 1 is passed through the collision point 9 may be computed from beam detection data from the beam detector 38 and the distance between the collision point 9 and the beam detector 38 as illustrated in FIG. 6. Alternatively, the moment when the electron beam 1 is passed through the collision point 9 may be computed from the timing of a synchronization signal from the synchronizer 29 and the time until the electron beam 1 corresponding to the synchronization signal given to the high-frequency power source 18 reaches the collision point 9.

As such, when the X-ray waveform is generated by removing detection data, other than the detection data corresponding to when the electron beam 1 is passed through the collision point 9, from among the X-ray detection data, there remains only a part in which the X-ray 4 generated by inverse Compton scattering is detected and other noise X-ray components are removed. Accordingly, the X-ray 4 may be measured at a high S/N ratio even when the shield is reduced or eliminated.

Third Embodiment

Figure 7:
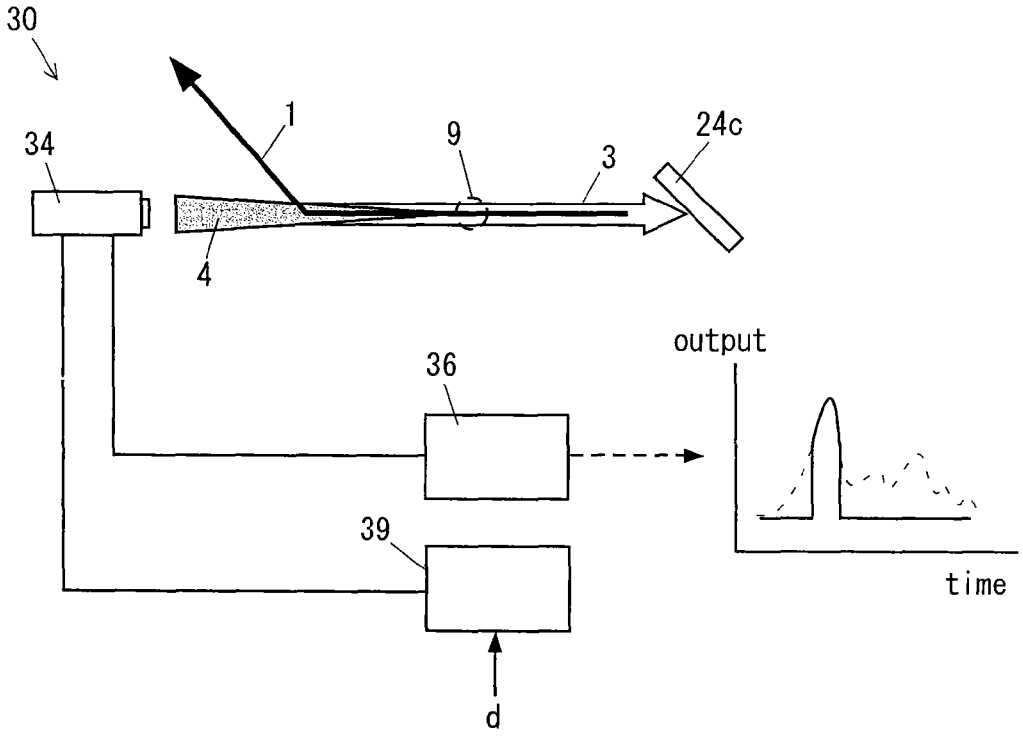
FIG. 7 is a diagram illustrating the constitution of an X-ray metering apparatus according to a third embodiment of the present invention.

FIG. 7 is a constitution diagram of an X-ray metering apparatus 30 according to a third embodiment of the present invention.

The X-ray metering apparatus 30 of this embodiment includes an X-ray detector 34 which detects an X-ray, an X-ray meter 36 which generates an X-ray waveform on the basis of X-ray detection data from the X-ray detector 34, and a detector controller 39 which controls the X-ray detector 34.

The detector controller 39 controls the X-ray detector 34 to detect an X-ray 4 only when the X-ray 4 generated at a collision point 9 enters the X-ray detector 34.

In this embodiment, laser light 3 and an electron beam 1 may be pulse-like or continuous.

When both the laser light 3 and the electron beam 1 are pulse-like and a pulse width of the electron beam 1 is equal to or greater than that of the laser light 3, or when the laser light 3 is pulse-like and the electron beam 1 is continuous, the X-ray 4 is generated by inverse Compton scattering in a time when the laser light 3 is passed through the collision point 9. Accordingly, in this case, a moment (timing) when the X-ray 4 generated at the collision point 9 enters the X-ray detector 34 may be identified from the timing of a synchronization signal output from the synchronizer 29 to the laser generator 28, a required time when a laser pulse corresponding to the synchronization signal given to the laser generator 28 reaches the collision point 9, and a required time when the X-ray 4 generated at the collision point 9 reaches the X-ray detector 34.

Since the above-described synchronization signal d is input to the detector controller 39, which controls the X-ray detector 34 to detect the X-ray 4 only when the X-ray 4 generated at the collision point 9 enters the X-ray detector 34 by calculating the moment when the X-ray 4 generated at the collision point 9 enters the X-ray detector 34 on the basis of the synchronization signal d.

When the laser light 3 is continuous and the electron beam 1 are pulse-like or when both the laser light 3 and the electron beam 1 are pulse-like and a pulse width of the laser light 3 is equal to or greater than that of the electron beam 1, the X-ray 4 is generated by inverse Compton scattering in a time when the electron beam 1 is passed through the collision point 9. Accordingly, in this case, the moment (timing) when the X-ray 4 generated at the collision point 9 enters the X-ray detector 34 may be identified from the timing of a synchronization signal output from the synchronizer 29 to the high-frequency power source 18, a required time when a pulse of the electron beam 1 corresponding to the synchronization signal given to the high-frequency power source 18 reaches the collision point 9, and a required time when the X-ray 4 generated at the collision point 9 reaches the X-ray detector 34.

Since the above-described synchronization signal d is input to the detector controller 39, which controls the X-ray detector 34 to detect the X-ray 4 only when the X-ray 4 generated at the collision point 9 enters the X-ray detector 34 by calculating the moment when the X-ray 4 generated at the collision point 9 enters the X-ray detector 34 on the basis of the synchronization signal d.

As such, since the X-ray 4 is detected only when the X-ray 4 generated at the collision point 9 enters the X-ray detector 34, only the X-ray 4 generated by inverse Compton scattering may be detected. As a result, an X-ray waveform from which a noise X-ray has been removed is generated like a waveform of the solid line schematically illustrated on the right of FIG. 7. In addition, a waveform indicated by the broken line of FIG. 7 is an X-ray waveform when a noise X-ray is not removed.

According to this embodiment, the X-ray 4 may be measured at a high S/N ratio even when the shield is reduced or eliminated. Since the peripheral of the X-ray detector 34 may be compactly designed by reducing the shield, it is possible to miniaturize the whole device.

While the embodiments of the invention have been described above, the foregoing disclosed embodiments of the invention are merely exemplified to the end, and the scope of the invention is not limited to these embodiments of the invention. The scope of the invention is shown by the scope of the claims and includes all modifications in the equivalent meanings and within the scope of the claims.

The invention claimed is:

1. An X-ray metering apparatus for measuring an X-ray generated by inverse Compton scattering by colliding an electron beam with laser light at a predetermined collision point, the apparatus comprising:

an X-ray detector which detects an X-ray; and an X-ray meter which generates an X-ray waveform on the basis of X-ray detection data from the X-ray detector, wherein the X-ray meter generates the X-ray waveform by validating detection data corresponding to when the X-ray is generated at the collision point among the X-ray detection data from the X-ray detector and invalidating other data.

2. The X-ray metering apparatus according to claim 1, wherein the laser light is pulse laser light and the electron beam is a continuous electron beam or a pulse-like electron beam having a pulse width equal to or greater than that of the pulse laser light, wherein a laser light detector which detects the laser light is provided, wherein the X-ray meter generates the X-ray waveform by multiplying the X-ray detection data from the X-ray detector by laser light detection data from the laser light detector after making time axes coincident with respect to the collision point.

3. The X-ray metering apparatus according to claim 1, wherein the laser light is pulse laser light and the electron beam is a continuous electron beam or a pulse-like electron beam having a pulse width equal to or greater than that of the pulse laser light, wherein the X-ray meter generates the X-ray waveform by removing detection data, other than detection data corresponding to when the laser light is passed through the collision point, from among the X-ray detection data from the X-ray detector.

4. The X-ray metering apparatus according to claim 1, wherein the electron beam is a pulse-like electron beam and the laser light is continuous laser light or pulse laser light having a pulse width equal to or greater than that of the electron beam, wherein a beam detector which detects passing of the electron beam is provided, wherein the X-ray meter generates the X-ray waveform by multiplying the X-ray detection data from the X-ray detector by beam detection data from the beam detector after making time axes coincident with respect to the collision point.

5. The X-ray metering apparatus according to claim 1, wherein the electron beam is a pulse-like electron beam and the laser light is continuous laser light or pulse laser light having a pulse width equal to or greater than that of the electron beam, wherein the X-ray meter generates the X-ray waveform by removing detection data, other than detection data corresponding to when the electron beam is passed through the collision point, from among the X-ray detection data from the X-ray detector.

6. An X-ray metering apparatus for measuring an X-ray generated by inverse Compton scattering by colliding an electron beam with laser light at a predetermined collision point, the apparatus comprising:

an X-ray detector which detects an X-ray;

an X-ray meter which generates an X-ray waveform on the basis of X-ray detection data from the X-ray detector; and a detector controller which controls the X-ray detector, wherein the detector controller controls the X-ray detector to detect the X-ray only when the X-ray generated at the collision point enters the X-ray detector.

7. An X-ray metering method for measuring an X-ray generated by inverse Compton scattering by colliding an electron beam with laser light at a predetermined collision point, the method comprising:

detecting an X-ray; and generating an X-ray waveform by validating detection data corresponding to when the X-ray is generated at the collision point among obtained X-ray detection data and invalidating other data.

8. The X-ray metering method according to claim 7, wherein the laser light is pulse laser light and the electron beam is a continuous electron beam or a pulse-like electron beam having a pulse width equal to or greater than that of the pulse laser light, wherein the X-ray waveform is generated by detecting the laser light and multiplying the X-ray detection data by laser light detection data after making time axes coincident with respect to the collision point.

9. The X-ray metering method according to claim 7, wherein the laser light is pulse laser light and the electron beam is a continuous electron beam or a pulse-like electron beam having a pulse width equal to or greater than that of the pulse laser light, wherein the X-ray waveform is generated by removing detection data, other than detection data when the laser light is passed through a collision point, from among the X-ray detection data from the X-ray detector.

10. The X-ray metering method according to claim 7, wherein the electron beam is a pulse-like electron beam and the laser light is continuous laser light or pulse laser light having a pulse width equal to or greater than that of the electron beam, wherein the X-ray waveform is generated by detecting passing of the electron beam and multiplying the X-ray detection data by beam detection data after making time axes coincident with respect to the collision point.

11. The X-ray metering method according to claim 7, wherein the electron beam is a pulse-like electron beam and the laser light is continuous laser light or pulse laser light having a pulse width equal to or greater than that of the electron beam, wherein the X-ray waveform is generated by removing detection data, other than detection data when the electron beam is passed through the collision point, from among the X-ray detection data from the X-ray detector.

12. An X-ray metering method for measuring an X-ray generated by inverse Compton scattering by colliding an electron beam with laser light at a predetermined collision point, the method comprising:

detecting an X-ray only when the X-ray generated at the collision point enters an X-ray detector; and generating an X-ray waveform on the basis of obtained X-ray detection data.

* * * * *